US005392482A

United States Patent [19]

Drulias et al.

[11] Patent Number: 5,392,482

[45] Date of Patent: Feb. 28, 1995

[54] DISPOSABLE TOOTHBRUSH

[76] Inventors: Dean Drulias, 2901 S. Industrial Rd., Las Vegas, Nev. 89109; Loretta Davis, 557 E. Sahara, Ste. 111, Las Vegas, Nev. 89104

[21] Appl. No.: 157,461

[22] Filed: Nov. 26, 1993

[51] Int. Cl.[6] ..... A46B 9/04; A46B 11/00

[52] U.S. Cl. ..... 15/104.94; 15/167.1; 15/227

[58] Field of Search ..... 15/104.94, 110, 114, 15/167.1, 227

[56] References Cited

U.S. PATENT DOCUMENTS

| | | | |
|---|---|---|---|
| 1,611,525 | 12/1926 | Hendrickson | 15/114 |
| 1,894,413 | 1/1933 | Nenning et al. . | |
| 2,077,540 | 4/1937 | Welker | 15/227 |
| 2,763,885 | 9/1956 | Lyons | 206/361 |
| 3,078,856 | 2/1963 | Bender | 15/210 R |
| 3,368,668 | 2/1968 | Micciche | 15/167.1 |
| 3,583,019 | 6/1971 | Conklin, Jr. | 15/227 |
| 3,798,698 | 3/1974 | Conklin, Jr. | 15/227 |
| 4,308,860 | 1/1982 | Sanders | 15/227 |
| 4,628,564 | 12/1986 | Youssef | 15/110 |
| 5,213,428 | 5/1993 | Salman | 15/227 |

FOREIGN PATENT DOCUMENTS

| | | | |
|---|---|---|---|
| 928115 | 5/1947 | France | 15/227 |
| 2571601 | 4/1986 | France | 15/227 |
| 3228679 | 2/1984 | Germany | 15/167.1 |
| 398919 | 9/1933 | United Kingdom | 15/227 |
| 2043438 | 10/1980 | United Kingdom | 15/227 |
| 2144032 | 2/1985 | United Kingdom | 15/227 |

*Primary Examiner*—David A. Scherbel
*Assistant Examiner*—Randall E. Chin
*Attorney, Agent, or Firm*—Charles H. Thomas

[57] ABSTRACT

A toothbrush is provided which avoids the use of a rigid handle. The toothbrush utilizes a brushing element mounted on a sheath that fits over the tip of a user's finger. The brushing element may include a plurality of bristles projecting outwardly from a stiff base which holds the bristles so as to extend away from the finger of a user. The bristles therefore will not collapse against the sheath, but can be used to dislodge food particles from between the teeth. An alternative brushing element may take the form of a brush pad formed as a unitary structure from a resilient, water impervious material and having a multiplicity of protuberances that project therefrom outwardly away from the prophylactic rubber sheath mounted on the user's fingers. The protuberances aid in dislodging food. A stiff rubber pick may also be mounted on the sheath, either projecting from the center of the brush pad, or at a laterally spaced location therefrom. In still another embodiment the brushing element is formed as a brush pad constructed of a moisture absorbent material, such as felt or reticulating foam. The moisture absorbent brush pad may be impregnated with a dental hygienic substance such as a mouthwash or a dentifrice.

5 Claims, 3 Drawing Sheets

DISPOSABLE TOOTHBRUSH

BACKGROUND OF THE INVENTION

1. Field of the Invention

The present invention relates to a compact toothbrush designed for use as a disposable item.

2. Description of the Prior Art

There are many instances in which a compact disposable toothbrush is quite useful. Such an item is particularly useful for travelers, especially those individuals who are likely to travel on very short notice. Quite often such individuals simply do not have time to pack personal toiletry items for traveling overnight.

Among the personal items that are most indispensable to travelers are toothbrushes and toothpaste. Very typically an individual, when called upon to travel, will find it necessary to pack his or her personal toothbrush and a large tube of toothpaste for even a very short trip, which might involve only a single overnight stay.

A conventional toothbrush is normally formed as an elongated, molded rigid plastic structure approximately six or seven inches in length. One end of the structure is formed as a handle suitable to be gripped in the fingers and palm of the user. The other end of the structure is formed into a brushing head in which a multiplicity of bristles, arranged in groups or tufts, are mounted to project outwardly from the brush head in an orientation generally perpendicular thereto. The bristles have ends which are trapped by molding in the brush head. The opposite ends of the bristles extend out away from the brush head and are used to brush the users teeth.

One significant problem with the packing and transportation of conventional, household toothbrushes is that it is difficult to maintain a conventional, household toothbrush in a sanitary condition while traveling. Typically such a toothbrush is placed in a toiletry bag along with a comb or brush shaving articles, deodorants, and possibly other personal toiletry items as well. When packed loosely with such items the bristles are likely to become contaminated with strands of hair, particles of soap, and other debris which may exist loosely within a toiletry bag. This poses a health hazard once the brush is inserted into the user's mouth for brushing the user's teeth, since the bristles carry dirt, germs and bacteria from such sources of contamination. While an individual may utilize a toothbrush holder, which may take the form of a box or tube, such toothbrush holders frequently become contaminated as well when used or stored for any length of time. Also, they present additional bulk and weight that must be carried.

Also, a conventional toothbrush is somewhat awkward to pack for travel on short notice, especially for those travelers who travel very lightly. For example, there is no real place to pack a toothbrush in a briefcase. Furthermore, not infrequently a conventional toothbrush will come loose in a briefcase and become damaged by the hinge mechanism with which the case is opened and closed.

Many years ago an attempt was made to provide a compact toothbrush which could be easily packed, carried on the person of the wearer and discarded after use. Such a toothbrush is described in U.S. Pat. No. 1,894,413. This brush was formed with a "cot" or sheath designed for mounting on the tip of a user's finger. The device employed a pad of bristles secured to a piece of woven material attached to the sheath. However, the toothbrush of U.S. Pat. No. 1,894,413 has a very pronounced disadvantage in that the bristles are not supported so as to remain projecting outwardly from the sheath, but rather are only limply attached thereto. As a consequence, the bristles of the toothbrush did not serve as structure which could extend in between the user's teeth so as to dislodge food particles therefrom.

SUMMARY OF THE INVENTION

The present invention is an improved form of toothbrush which is extremely compact, highly sanitary, and which can be discarded following use. The toothbrush of the invention is so compact that it can easily be carried in a person's pocket or purse. Nevertheless, the toothbrush of the invention is effective in brushing between the user's teeth so as to dislodge food particles therefrom.

The toothbrush of the invention is designed for use by all adults and pets. It is formed by an elastic, prophylactic rubber jacket which fits over the tip of the index finger of a user. Near the end of the latex finger cover at a position proximate the ball of the fingertip a brush element is attached by adhesive. In one embodiment the brush element includes a central relatively rigid molded plastic or rubber base having bristles extending perpendicularly outwardly therefrom. The bristles may be formed of nylon with ends embedded in the base, or the bristles and base may be formed together as a unitary structure, In either case the disk may be mounted beneath a shoulder of an annular felt or foam rubber pad so that the bristles slick out beyond the outer surface of the felt pad. Both the undersurface of the base and the edge of the annular felt or foam rubber collar residing in co-planar relationship therewith are permanently glued to the latex mounting.

To use the device the wearer slips the latex holder onto the fingertip and brushes his or her teeth using the projecting bristles. The device may be disposable, but in any event is quite compact.

In an alternative design the brush element is formed merely by the configuration of a small felt or foam rubber disk having an "egg crate" or "waffle iron" outer surface, or a flat outer surface if the brush element is formed of a lightly abrasive foam material. The device may or may not include a rubber pick mounted so as to protrude beyond the pad or at some other location on the sheath. In still another arrangement designed primarily for mouth freshening, a felt foam rubber or other absorbent brush or pad impregnated with a mouthwash or mouth freshening solution is mounted on one side of the prophylactic carrier.

In one broad aspect the present invention may be considered to be a toothbrush comprising a sheath formed in a size to fit snugly on the finger of a user, a stiff bristle base having a flat undersurface and an opposite exposed surface wherein said undersurface is juxtaposed against and firmly secured to said sheath, and a plurality of bristles. The bristles have anchored ends firmly secured to the bristle base and opposite exposed ends that project outwardly from the exposed surface of the bristle base. The bristle base thereby maintains the bristles mounted in an orientation normal or perpendicular to the undersurface of the bristle base.

The present invention has an advantage over prior compact toothbrush systems that involve no handle in that it provides brushing elements capable of reaching the crevices between the teeth of a user such that particles of food are effectively dislodged from between the user's teeth. Plaque can be effectively brushed from the teeth as well.

The sheath employed in the toothbrush of the invention is preferably formed of a moisture impermeable, elastic material, such as prophylactic rubber. The bristle base may be formed of a molded plastic material with the bristles being formed of nylon or some other plastic. Alternatively, the bristle base and bristles may be formed together as a unitary structure from hard rubber or a stiff, but not rigid, plastic.

In one embodiment of the invention the exposed surface of the bristle base is formed with a central, outwardly projecting pedestal from which the bristles project. This pedestal is surrounded by an annular shoulder. A resilient, moisture absorbent collar, which may be constructed of felt or reticulating foam, is secured to the sheath and is disposed about the bristle base to extend over the shoulder thereof. The moisture absorbent collar thereby provides a cushion and prevents the rigid bristle base from bruising or irritating the user's gums. In addition, a dentifrice may be impregnated into the moisture absorbent collar so that the toothbrush is equipped with its own supply of toothpaste or toothpowder. Thus, a user need merely wet the brushing element or use saliva and begin running the bristles across and between his or her teeth. The dentifrice impregnated into the porous collar is thereby immediately available and is released upon moistening for assistance in cleaning plaque from the teeth and for freshening the user's breath.

In another broad aspect the invention may be described as a sheath formed to fit snugly on the fingertip of a user, and a brush pad formed as a unitary structure from a resilient, water impervious material and having a smooth underside firmly attached to the sheath and an opposite exposed side formed with a multiplicity of protuberances projecting therefrom in a direction normal to the underside. The brush pad may be formed of injection rubber and the sheath may be formed of prophylactic rubber.

By constructing the brush pad in this manner a multiplicity of small projections are provided which are useful in brushing the teeth. These projections do not collapse, as with prior art toothbrushes that avoid the use of handles, but rather are held to extend outwardly and into the crevices in and between a user's teeth.

To enhance the ability to dislodge food particles a stiff pick may be secured to the sheath to project outwardly therefrom. The pick may be mounted on a side of the sheath opposite the brush pad so that the user, by twisting the finger carrying the sheath to an appropriate degree, is able to use the pick either to dislodge food particles from between the teeth, or brush plaque from the smoother surfaces of the teeth using the brush pad. Alternatively, the brush pad may be formed in an annular configuration with a central opening therein and the pick may be mounted in the central opening to project outwardly beyond the protuberances of the brush pad.

In an alternative configuration the brush pad may be formed as an annular structure defining a central opening therein without the pick. Instead, the opening may be filled with a dentifrice, such as toothpaste or toothpowder. After inserting the sheath onto the tip of a finger, the user need merely hold the fingertip in water for a moment to moisten the dentifrice and then use the toothbrush to clean the user's teeth.

In yet another aspect the invention may be described as a sheath formed to fit snugly over the fingertip of a user, and a brush pad formed as a unitary structure of a moisture absorbent material firmly secured to the sheath and impregnated with a dental hygienic substance. The brush pad may be formed of felt or reticulating foam. The dental hygienic substance may either be a mouthwash or a dentifrice.

The invention may be described with greater clarity and particularity by reference to the accompanying drawings.

DESCRIPTION OF THE EMBODIMENT

Figure 1:
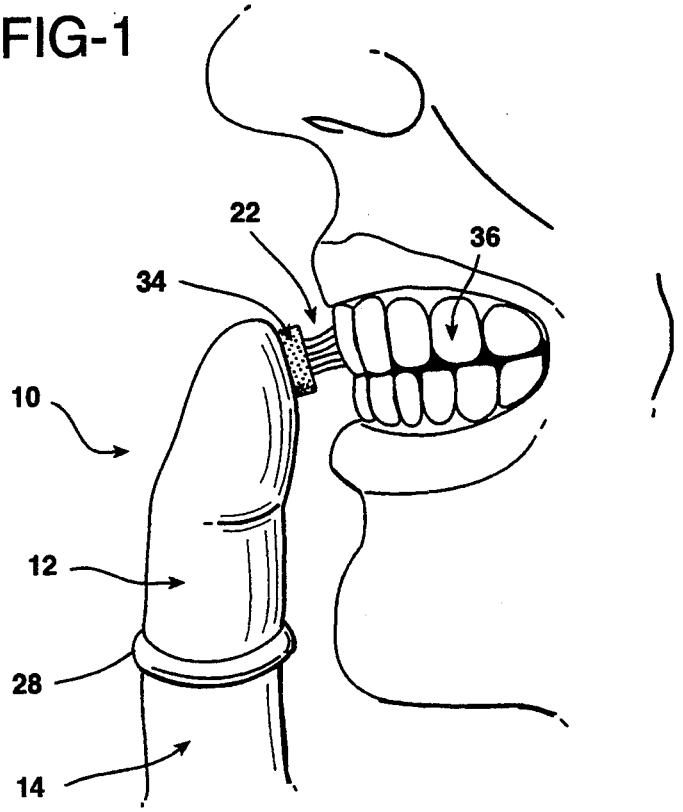
FIG. 1 is an elevational view illustrating the use of one embodiment of the of the invention.
Figure 2:
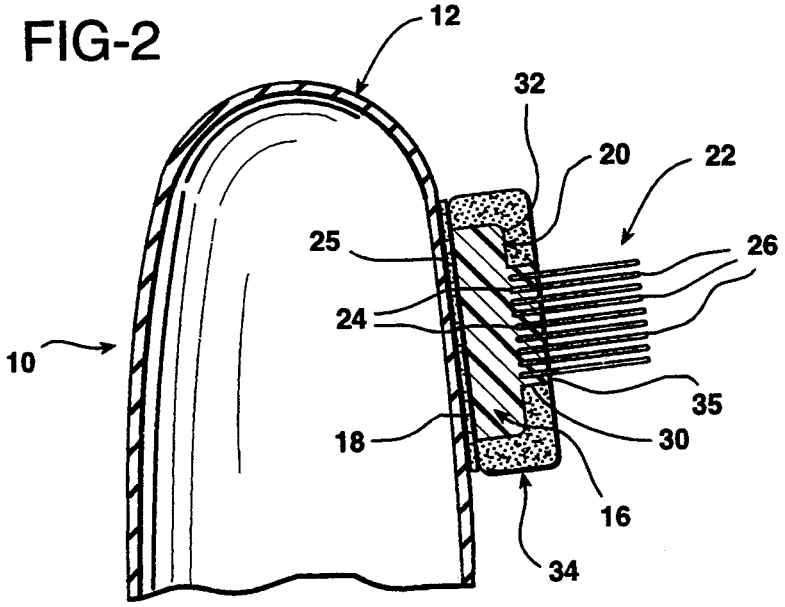
FIG. 2 is a sectional elevational view of the upper portion of the toothbrush of FIG. 1.

FIG. 1 illustrates a toothbrush indicated generally at 10 formed of a prophylactic latex rubber sheath 12 formed in a size to fit snugly on the finger 14 of a user. As illustrated in FIG. 2, the toothbrush 10 has a rigid bristle base 16 having a flat undersurface 18 and an opposite exposed surface 20. The undersurface 18 of the bristle base 16 is juxtaposed against and firmly secured to the sheath 12 by a layer 25 of a rubber based or epoxy adhesive.

The bristle base 16 is formed of molded plastic, such as polyvinyl chloride, rigid urethane, ABS, or any other moldable rigid plastic that can be bonded to the latex rubber sheath 12. The toothbrush 10 is provided with a plurality of bristles indicated collectively at 22. The bristles 22 have anchored ends 24 firmly embedded in the bristle base 16 and opposite exposed ends 26 that project outwardly from the exposed surface 20 of the bristle base 16. The bristles 22 may be constructed of nylon and are embedded in the bristle base 16 by molding the bristle base 16 about the bristle ends 24. The bristle base 16 thereby holds the bristles 22 so that they are in an orientation normal to the bristle base undersurface 18.

The sheath 12 is elastic enough to stretch to fit fingers 14 of different sizes. The sheath 12 is a tubular, balloon-like structure having a closed end adjacent to which the bristle base 16 is mounted, and a remote open end. The structure of the sheath 12 terminates in a reinforcing roll or bead 28 at the open end of the sheath.

Figure 3:
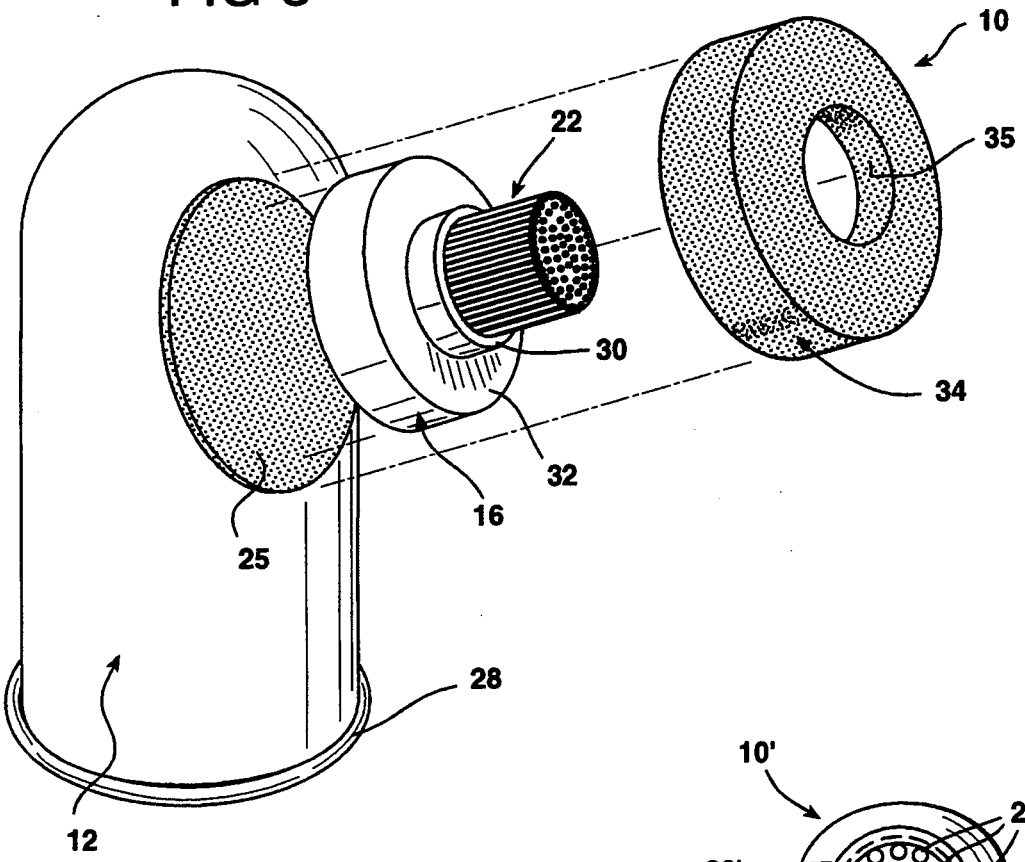
FIG. 3 is an exploded view of the toothbrush of FIGS. 1 and 2.

The exposed surface 20 of the bristle base 16 may be formed with a central, outwardly projecting pedestal 30 from which the bristles 22 extend. The pedestal 30 is surrounded by an annular shoulder 32, as shown in FIGS. 2 and 3. The pedestal or sleeve 30 is an optional feature which is sometimes of assistance in more firmly anchoring the ends 24 of the bristles 26. However, the pedestal 30 may be eliminated and the bristle base 16 formed simply as a disk-shaped structure approximately 10 to 15 millimeters in diameter with the bristle ends 24 embedded therein and extending from one face thereof if desired.

In the embodiment of FIGS. 1-3 the toothbrush 10 is further comprised of a resilient, moisture absorbent collar 34. The collar 34 may be formed of felt or reticulating foam and is shaped as an annular structure with a central opening 35 therein of a size adapted to receive and surround the pedestal 30. The collar is preferably about 4 millimeters in thickness.

Both the collar 34 and the bristle base 16 are secured to the sheath 12 by the adhesive layer 25 between about 5 and 20 millimeters from the extremity of the closed end of the sheath 12. The bristle base 16 and collar 34 are mounted at a location on the sheath 12 proximate the ball of the tip of the user's index finger 14 when the sheath 12 is mounted on the finger 14. This allows the user maximum control in the manipulation of the bristles 22.

The moisture absorbent collar 34 may be impregnated with a dentifrice, such as toothpaste or toothpowder. Just a few drops of water on the cushioning collar 34 will allow the dentifrice to be released and become available for use in brushing the user's teeth 36 in the manner illustrated in FIG. 1.

To manufacture the toothbrush 10, the prophylactic rubber sheath 12 is formed by a conventional molding process. Plastic resin is poured into a mold cavity and cured to form the bristle base 16 with preformed openings for the bristles 22. The ends 24 of the bristles 22 are then inserted into the openings and secured therein by some adhesive, such as an epoxy resin. The ends 24 of the bristles 22 are thereby securely embedded and anchored in the bristle base 16. The collar 34 is formed by molding and curing a foam or reticulated rubber in a mold, or by cutting from a layer of felt material to form the structure indicated. The collar 34 is then inserted onto the bristle base 16 with the bristles 22 projecting through the central opening 35 in the collar 34.

An adhesive compatible with the prophylactic rubber sheath 12, the bristle base 16, and the collar 34 is then applied to the underside 18 of the bristle base 16 and also to the surrounding, annular co-planar surface of the collar 34. The bristle base 16 and collar 34 are then pressed against the outer surface of the sheath 12 until the adhesive layer 25 cures.

Preferably, the toothbrush 10 is then collapsed into a very compact form by rolling the structure of the sheath 12, beginning with the reinforcing bead 28, up into an annular ring about the collar 34 and bristle base 16 for packaging purposes. The collapsed toothbrush 10 is preferably encapsulated in between moisture impermeable, sanitized, sheets of plastic or foil, which are sealed about their edges to isolate the toothbrush 10 frown moisture. When constructed and packaged in this manner, a plurality of the tiny, collapsed toothbrushes 10 may be packaged together and sold in quantities of six, ten, twelve or any other appropriate number as disposable items.

To utilize the toothbrush of the invention, the moisture seal for a selected toothbrush 10 is broken and the toothbrush 10 is removed from its package. The user then inserts the tip of the index finger 14 into contact with the inside of the sheath 12 so that the ball of the index or another finger is pressed against the inner surface of the sheath 12 adjacent the underside 18 of the bristle base 16. The elastic structure of the sheath 12 is then unrolled so that the sheath 12 covers the end of the finger 14 down to below the first finger joint. When unrolled the sheath 12 is about one and one half inches in length and the reinforcing bead 28 thereon encircles the finger 14 just above the second joint from the end of the finger 14.

With the toothbrush 10 deployed in this manner the user then moistens the collar 34 with water either by holding the sheathed fingertip under a stream of running water, or by dipping the sheathed fingertip into a glass of water. Once the collar 34 is moistened, the toothpaste or toothpowder carried within the collar 34 emanates therefrom, and is brushed on and in between the teeth by means of the bristles 22. Alternatively, the toothpaste can be supplied in a foil or plastic packet attached to the toothbrush and applied to the brush element for use. In either case the user then proceeds to brush his or her teeth 36 in the manner illustrated in FIG. 1. The bristles 22 are held by the bristle base 16 so as to project outwardly therefrom, normal to the plane of the underside 18 of the bristle base 16. In this way the exposed ends of the bristles 26 can reach in between the individual teeth 36 and into recesses in the teeth so as to dislodge food particles therefrom, which are particularly pronounced in molars.

Once the user has finished cleaning his or her teeth 36 to a satisfactory degree, the sheath 12 is removed from the finger 14 and the toothbrush 10 is discarded. The sheath 12 may be removed by merely reversing the process used to mount it on the finger 14. That is, the sheath 12 is rolled up away from the user's second finger joint and toward the tip of the finger 14 until the sheath 12 can be easily pulled off of the user's finger with the other hand. The used toothbrush 10 can then be discarded.

Figure 5:
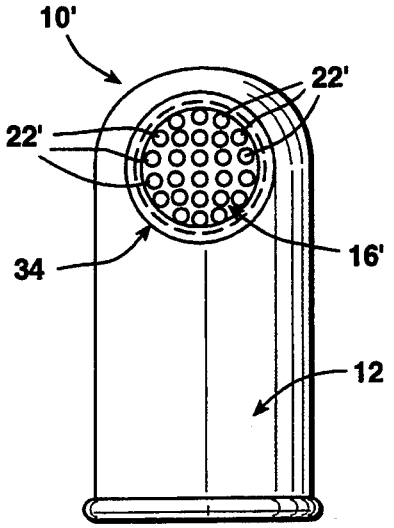
FIG. 5 is a front elevational view of the embodiment of FIG. 4.
Figure 4:
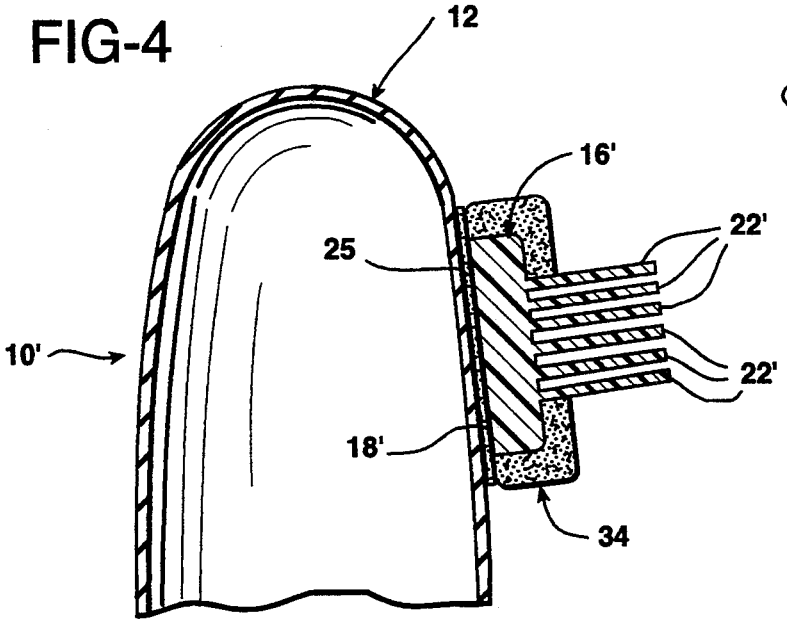
FIG. 4 is a sectional elevational view showing a modified form of the embodiment of FIGS. 1–3.

FIGS. 4 and 5 illustrate a modified form of the embodiment of FIGS. 1-3. In the modification of FIGS. 4 and 5 a unitary rubber brush element 16' formed of stiff, hard rubber and having bristles 22' formed of a plurality of stiff, cylindrical rubber rod-like or spike-like fingers or rubber brush-like bristles, is substituted for the bristle base 16 and bristles 22 in the toothbrush 10'. The surface 18' of the brush element 16' is secured by adhesive directly to the prophylactic rubber sheath 12 by an adhesive layer 25 and the collar 34 is mounted thereabout as previously described. The cost of fabrication of the toothbrush 10' is less than that of the toothbrush 10. The rubber fingers or bristles 22' are stiff, though not rigid, and are quite narrow. They perform the same function as the bristles 22 in the toothbrush 10. The brush element 16' may be constructed with any number of fingers or bristles 22' from just a few to a multiplicity. The toothbrush 10' is utilized in the same manner as the toothbrush 10 and is otherwise similar thereto.

Figure 6:
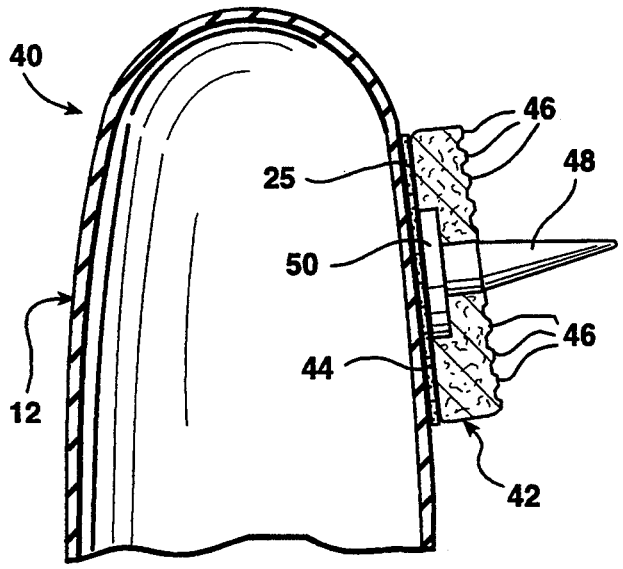
FIG. 6 is a sectional elevational detail showing the upper portion of another embodiment of the toothbrush of the invention.

FIG. 6 illustrates an alternative embodiment of the invention. Like the embodiment of FIGS. 1 and 3 the toothbrush 40 depicted in FIG. 6 employs a prophylactic rubber sheath 12 formed to fit snugly on the fingertip of a user. A brush pad 42 is mounted on the sheath 12. The brush pad 42 is formed as a unitary structure from a resilient material, such as reticulating rubber. The brush pad 42 has a smooth undersurface 44 that is firmly attached to the sheath 12 by means of a layer 25 of adhesive, in the manner of the embodiments of FIGS. 2 and 4, and an opposite exposed side formed with a multiplicity of protuberances 46 projecting therefrom in a direction normal to the underside 44. The protuberances 46 may be configured in a "egg crate" configuration in which the projections 46 extend outwardly from the structure of the brush pad 42 and are separated from each other by valleys or crevices therebetween. Alternatively, the outer surface of the brush pad 42 may be smooth if it is formed of a lightly abrasive material.

The protuberances 46 project sufficiently in the manner of the bristles 22 to extend into many of the spaces between the teeth 36 of a user so as to dislodge particles of food therefrom, and so as to be able to scrub plaque from the surfaces of the teeth 36. In the embodiment illustrated in FIG. 6, the brush pad 42 is formed in an annular configuration with a central opening therein. The brush pad 42 is mounted at about the same location on the sheath 12 as is the bristle base 16 in the toothbrush 10. Also, a stiff pick 48, formed of hard rubber, is mounted in the central opening in the brush pad 42. The pick 48 extends outwardly normal to the orientation of the underside 44 of the brush pad 42 and is captured between the brush pad 42 and the sheath 12 by means of a radially extending disk-shaped base 50, integrally formed with the pick 48. The base 50 and the underside 44 of the brush pad 42 are both secured by the adhesive layer 25 to the sheath 12.

The toothbrush 40 is employed for brushing teeth in essentially the same manner as the toothbrush 10. The principal difference is that the pick 48 is guided to follow the crevices between the teeth 36, and the protuberances 46 are utilized to scrub the outwardly facing surfaces of the teeth.

Figure 7:
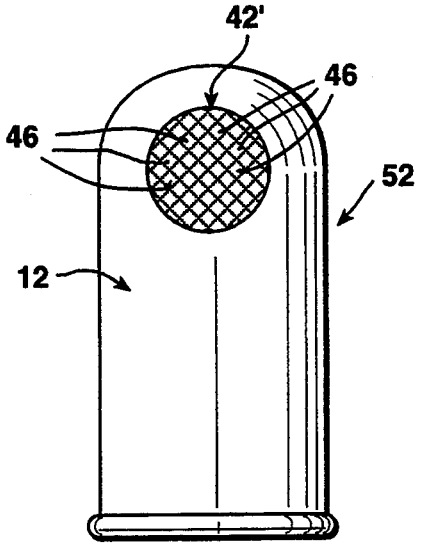
FIG. 7 is a front elevational view of still another embodiment of the toothbrush of the invention.
Figure 8:
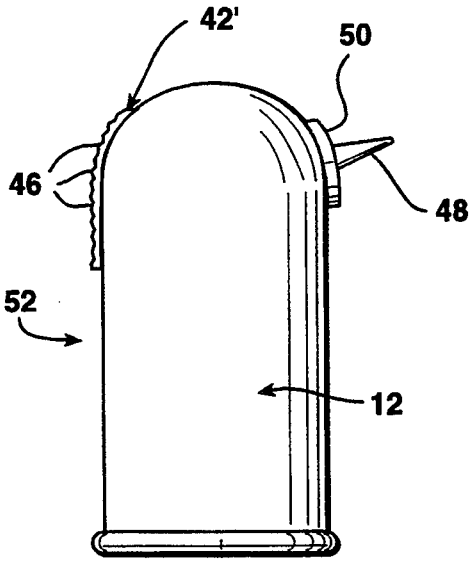
FIG. 8 is a side elevational view of the embodiment of FIG. 7.

An alternative embodiment of the invention to that illustrated in FIG. 6 is depicted in FIGS. 7 and 8. The toothbrush 52 depicted in FIGS. 7 and 8 employs a sheath 12, a brush pad 42' and a stiff rubber pick 48. The brush pad 42' and the base 50 of the rubber pick 48 are secured to the sheath 12 by separate layers of adhesive in the manner depicted in FIG. 6. In this embodiment the brush pad 42' is likewise formed and mounted on a sheath 12 in the same manner as the brush pad 42 with a multiplicity of protuberances 46 projecting therefrom in a direction perpendicular to the underside of the brush pad 42'. However, the brush pad 42' is shaped as an essentially disk-shaped structure having protuberances 46 on the outer face thereof, without any central opening therein. Instead, the base 50 of the pick 48 is secured to the outer surface of the sheath 12 by another layer of adhesive at a location on the sheath 12 opposite the brush pad 42'. Thus, the user utilizes the brush pad 42' to blush the surfaces of the teeth 36 in the manner depicted in FIG. 1, but twists the finger 14 so as to insert the pick 48 in between the crevices between adjacent teeth, so as to dislodge food particles therefrom.

Figure 9:
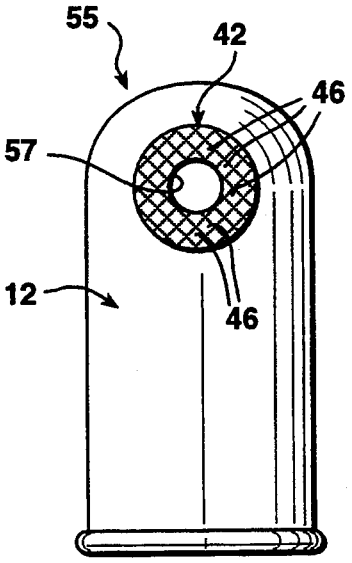
FIG. 9 is a front elevational view of still another embodiment of a toothbrush according to the invention.

In another alternative embodiment of the invention to that depicted in FIG. 6 the pick 48 may be omitted from the toothbrush, and instead the central opening 57 in the brush pad 42 may be filled with a dentifrice. Such a toothbrush is illustrated at 55 in FIG. 9. When the toothbrush 55 is utilized, the center of the brush pad 42 is merely wetted with water to thereby enable the dentifrice to be spread easily from the opening 57 and to be deployed in a mild abrasive action by means of the protuberances 46. The dentifrice thereby facilitates removal of plaque from the teeth 36.

Figure 10:
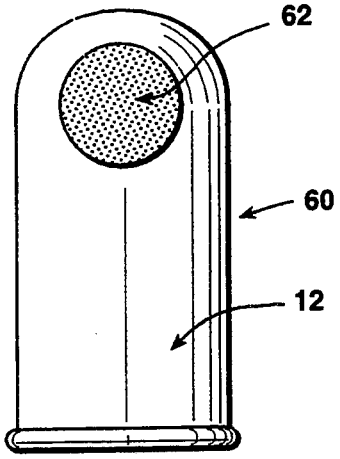
FIG. 10 is a front elevational view of yet another embodiment of the invention.

Still another embodiment of the invention is depicted in FIG. 10. As with the other embodiments of the invention illustrated, the toothbrush 60 is formed with a sheath 12 that fits snugly over the fingertip of a user. The brush pad 62 is formed as a disk-shaped structure and is secured to the sheath 12 with an adhesive in the manner illustrated in FIGS. 2 and 4. The brush pad 62 is formed of either felt or reticulating foam. In the embodiment of FIG. 10 the moisture absorbent pad 62 is impregnated with a dental hygienic substance. For example, the pad 62 may be saturated with a mouthwash, or impregnated with a dentifrice such as toothpaste or a toothpowder. The embodiment of FIG. 10 is designed primarily for freshening the user's mouth and therefore does not employ a pick as do the embodiments of FIGS. 6–8.

By having a small brush element mounted so that it can be carried on a user's fingertip, a toothbrush according to the invention has a great advantage of being highly manipulatable. Unlike a conventional toothbrush with a relatively long rigid handle, the toothbrush of the invention can be moved within the mouth into many different positions and at angles that are not possible using a toothbrush with a handle. The dexterity of a user's finger movement aids in positioning the brush element precisely as desired by the user. This is especially important in brushing teeth at the back of the user's mouth. The portability and compactness of the toothbrush of the invention allows it to be used virtually anywhere. It can be used while driving, in offices, after eating at restaurants, or an any other time. It can be carried in a wallet, purse, glove compartment or stored in a desk.

Undoubtedly, numerous variations and modifications of the invention will become readily apparent to those familiar with the construction of toothbrushes and the practice of oral hygiene. Accordingly, the scope of the invention should not be construed as limited to the specific embodiments depicted and described herein.

We claim:

1. A toothbrush comprising: a sheath formed in a size to fit snugly on the finger of a user, a stiff bristle base having an undersurface and an opposite exposed surface wherein said undersurface is juxtaposed against and firmly secured to said sheath and said exposed surface is formed with a central outwardly projecting pedestal and an annular shoulder surrounding said pedestal, a plurality of bristles having anchored ends firmly secured to said bristle base and opposite exposed ends that project outwardly from said pedestal, whereby said bristle base maintains said bristles mounted in an orientation normal to said undersurface of said bristle base, and a resilient, moisture absorbent collar secured to said sheath and disposed about said bristle base to extend over said shoulder thereof.

2. A toothbrush according to claim 1 further comprising a dentifrice impregnated into said moisture absorbent collar.

3. A toothbrush comprising: a sheath formed in a size to fit snugly on the finger of a user, a stiff bristle base having an undersurface and an opposite exposed surface with a central region wherein said undersurface is juxtaposed against and firmly secured to said sheath, a plurality of bristles having anchored ends firmly secured to said bristle base and opposite exposed ends that project outwardly from said central region of said bristle base and further comprising an annular protective collar formed of a resilient moisture absorbent material secured to said sheath and disposed about said bristle base so as to surround said central region of said exposed surface thereof.

4. A toothbrush according to claim 3 wherein said sheath is formed of prophylactic rubber and said protective collar is formed of felt.

5. A toothbrush according to claim 3 wherein said sheath is formed of prophylactic rubber and said protective collar is formed of reticulating foam.

* * * * *